United States Patent [19]

Sharrah et al.

[11] Patent Number: 4,916,596

[45] Date of Patent: Apr. 10, 1990

[54] CONVERTIBLE FLASHLIGHT

[75] Inventors: Raymond L. Sharrah, Collegeville, Pa.; Hari Matsuda, Evanston; Craig Cors, Aurora, both of Ill.

[73] Assignee: Steamlight, Inc., Norristown, Pa.

[21] Appl. No.: 293,874

[22] Filed: Jan. 5, 1989

[51] Int. Cl.[4] ..... F21L 7/00

[52] U.S. Cl. ..... 362/190; 362/187; 362/191; 362/196; 362/199; 362/197; 362/103

[58] Field of Search ..... 362/187, 196, 199, 190, 362/191, 103, 105, 106, 157, 197

[56] References Cited

U.S. PATENT DOCUMENTS

| | | | |
|---|---|---|---|
| 2,947,851 | 8/1960 | Lozeau | 362/187 |
| 3,341,701 | 9/1967 | Moore et al. | 362/196 |
| 4,400,763 | 8/1983 | Kribs et al. | 362/190 |
| 4,447,863 | 5/1984 | Fenne | 362/199 |
| 4,597,031 | 6/1986 | Isuyama | 362/191 |

FOREIGN PATENT DOCUMENTS

| | | | |
|---|---|---|---|
| 10597 | of 1913 | United Kingdom | 362/190 |

*Primary Examiner*—Ira S. Lazarus
*Assistant Examiner*—Sue Hagarman
*Attorney, Agent, or Firm*—Steele, Gould & Fried

[57] ABSTRACT

A flashlight that is convertible between a hand-held form and a body-mountable form is disclosed. The flashlight includes a head assembly, which houses the light bulb and the switching mechanism, and a body assembly which houses the power cells. The body assembly includes a pair of articulated arms which are hinged to the head assembly for forming a handle in the hand-held form or a yoke in the body-mountable form. An integral switching and focusing mechanism is provided in the head assembly. Axial displacement of the mechanism switches the flashlight on or off, whereas rotation of the mechanism moves a parabolic reflector relative to the light bulb so as to vary the focus of the light. The head assembly includes a lamp housing which is tiltable for directing the light beam. An electric circuit is provided to permit recharging of the flashlight power cells.

11 Claims, 12 Drawing Sheets

CONVERTIBLE FLASHLIGHT

FIELD OF THE INVENTION

This invention relates to a portable flashlight and, in particular, to such a flashlight that is convertible between to form providing a handle suitable for carrying by hand and a form providing a yoke device suitable for wearing on a person's body.

BACKGROUND OF THE INVENTION

There are numerous small hand-held flashlights which are lightweight and portable. Many such flashlights include such features as variable focusing of the light beam and rechargeability.

Electric headlamps are also known of the type suitable for wearing on a person's body or hat to provide hands-free illumination. The well-known miner's lamp is an example of such a headlamp. Some such headlamps include such features as variable focus light beam and light weight. A number of such headlamps, however, have a separate power source and require tilting of the wearer's body in order to aim the light beam.

All of the above-mentioned, known flashlights are limited to a single form: hand-held or body-mountable. Persons having a need for the useful features of both kinds of flashlights are thus required to have two flashlights: one for situations requiring a hand-held flashlight, and another for situations where a flashlight worn on the body is more useful. It would be highly desirable to have a flashlight which provides all of the advantages of a hand-held flashlight and a body-mountable lamp, and yet be compact and easy to carry.

SUMMARY OF THE INVENTION

The flashlight according to the present invention is convertible between a hand-held form and a body-mountable form which can be worn on a person's body for hands-free use. The flashlight includes a head assembly, a body assembly, and a retaining device, such as a strap, for retaining the flashlight on a person's body when used in the body-mountable form. A flashlight embodying the present invention thus shares the advantageous features of a conventional, hand-held flashlight with the advantages of a body-mountable lamp.

The head assembly encloses a lamp housing which holds the light bulb. The lamp housing includes a reflector having a central opening through which the light bulb projects such that light emanating from the light bulb is reflected out as a beam of light. The lamp housing is tiltably mounted in the head assembly so that the light beam can be directed onto a specific target when the flashlight is used in the body-mounted form.

The reflector, which is preferably parabolic concave, is slidably mounted in the lamp housing relative to the light bulb. Mechanical linkage is provided in the head assembly for effecting controlled displacement of the reflector relative to the light bulb so that the focus of the light beam emanating from the light bulb can be varied.

The head assembly further includes a switch that is integral with the focusing linkage. The integrated arrangement of focusing and switching permits the operator to adjust the focus without having to turn the light on or off. The focus adjustment can be left at a particular setting from use to use.

The body assembly is operatively connected to the head assembly and provides the convertible feature by having a first form providing a handle suitable for grasping by hand and a second form providing a yoke device suitable for mounting on a person's body. The body assembly includes a pair of arm assemblies each pivotally connected at one end to the head assembly. The other free ends of the arm assemblies can swing away from or toward each other. In the hand-held form the arm assemblies are held together by a clasp device to provide a handle. In the body-mountable form, the arm assemblies are swung apart to provide a yoke-like device which generally conforms to a person's forehead. Such an arrangement advantageously renders the flashlight more comfortable to wear by distributing pressure across a greater portion of the forehead, unlike a conventional head lamp.

The arm assemblies also house the batteries or power cells which energize the light bulb. Electrical circuitry is provided in the arm assemblies for conducting electrical energy to the light bulb and also to permit recharging of the batteries.

BRIEF DESCRIPTION OF THE DRAWINGS

The foregoing summary, as well as the following detailed description of a preferred embodiment of the present invention, will be better understood when read in connection with the appended drawings in which:

FIG. 4 is a partial view of the arrangement of the electrical contacts at the hinge between the arm assembly and the head assembly as viewed along line B—B in FIG. 4A;

DETAILED DESCRIPTION

Figure 1:
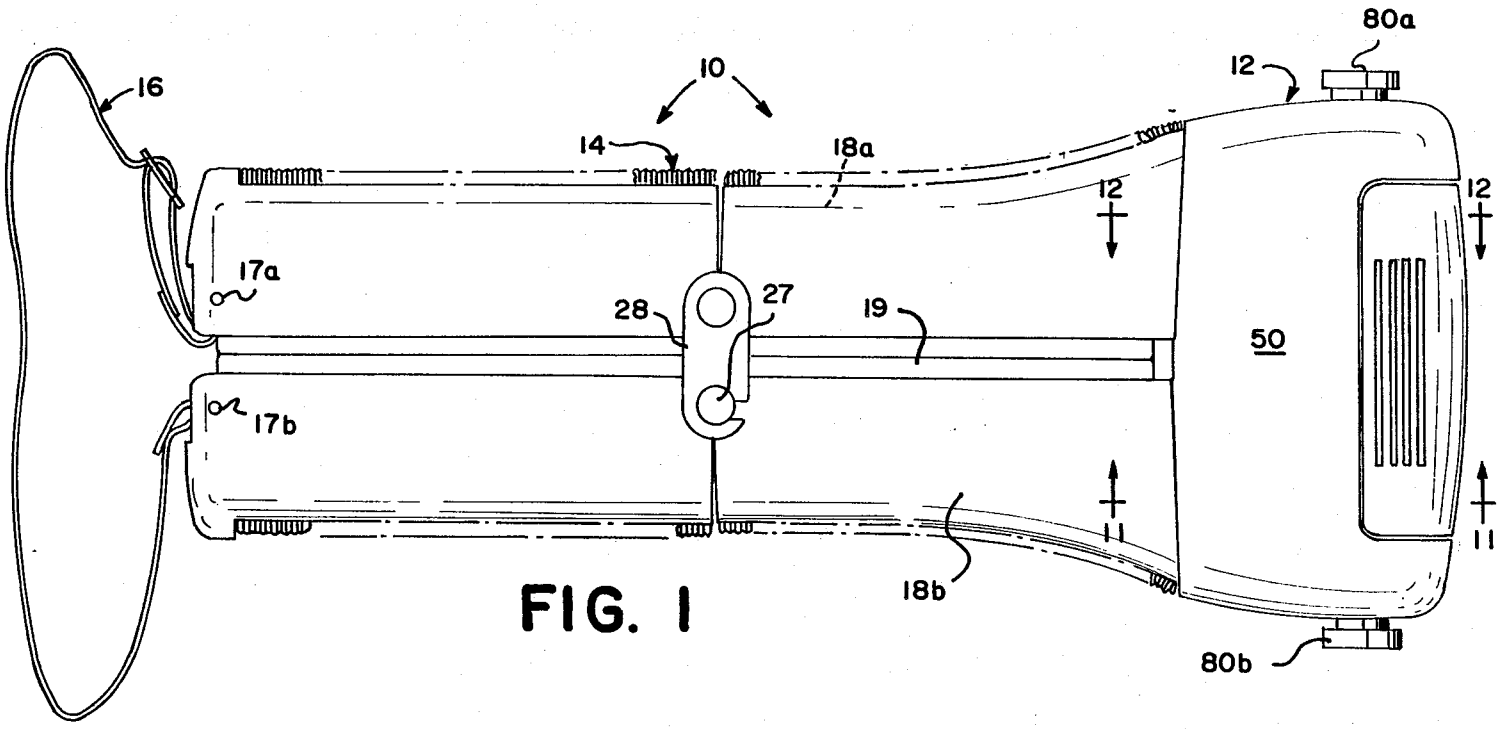
FIG. 1 is a general view of the hand-held form of a flashlight embodying the present invention.
Figure 2:
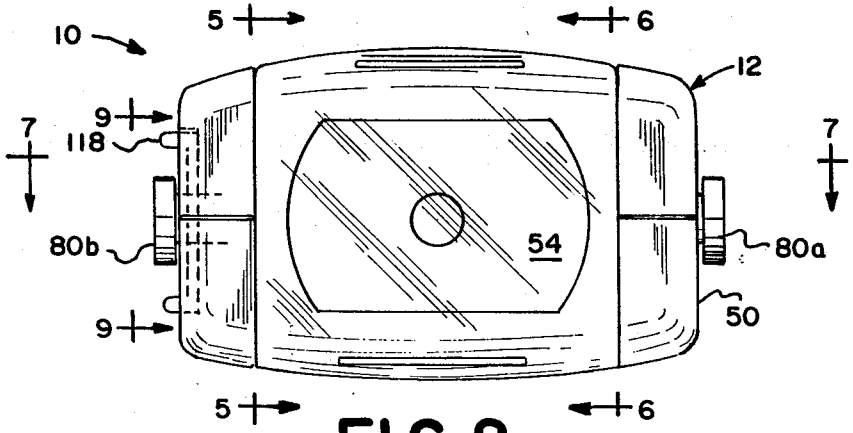
FIG. 2 is an end elevation view of the front end of the flashlight of FIG. 1.
Figure 3:
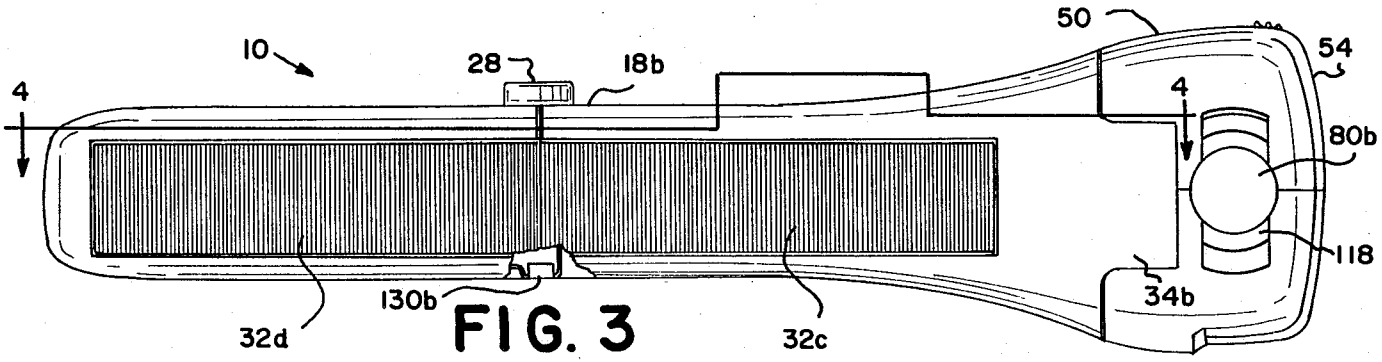
FIG. 3 is a side elevation view of the flashlight of FIG. 1.
Figure 13:
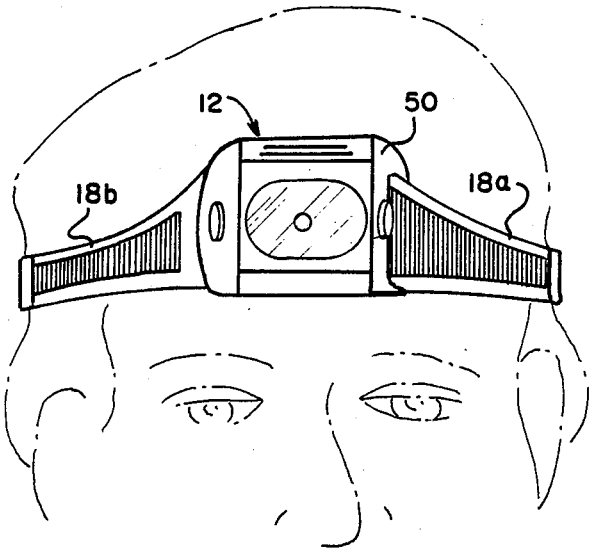
FIG. 13 shows a flashlight according to the present invention in the body-mountable form as worn on a person's forehead.

Referring now to the drawings wherein the same reference numerals indicate the same or similar parts among the several views, and in particular to FIGS. 1, 2, and 3, there is shown a flashlight 10 which embodies the present invention. In the embodiment shown, the flashlight 10 includes a head assembly 12, a body assembly 14, and a strap 16 attached at the tail-end of flashlight 10. The body assembly 14 includes a pair of arm assemblies 18*a* and 18*b*. As will be described more fully hereinbelow, the arm assemblies 18*a* and 18*b* are hinged to the head assembly 12 such that they can swing away or toward each other. When the arm assemblies 18*a* and 18*b* are swung together to a closed position as shown in FIG. 1, the flashlight forms a handle suitable for being hand-held. When the arm assemblies 18*a* and 18*b* are swung apart from each other to an open position, the flashlight forms a yoke device suitable to be worn on a person's forehead as shown in FIG. 13. Advantageously, the yoke arrangement distributes the pressure of the flashlight along a greater portion of the wearer's head to make it more comfortable to wear. The strap 16 spans between the free tail-ends of the arm assemblies and may encircle the scalp when the arm assemblies are open to retain the flshlight on the forehead or other body portion; and is preferably adjustable for retaining the flashlight on a person's body, thereby providing hands-free operation and use of the flashlight. The retainer strap, in the illustrated embodiment is elasticized to facilitate mounting and dismounting the flashlight 10.

Figure 4:
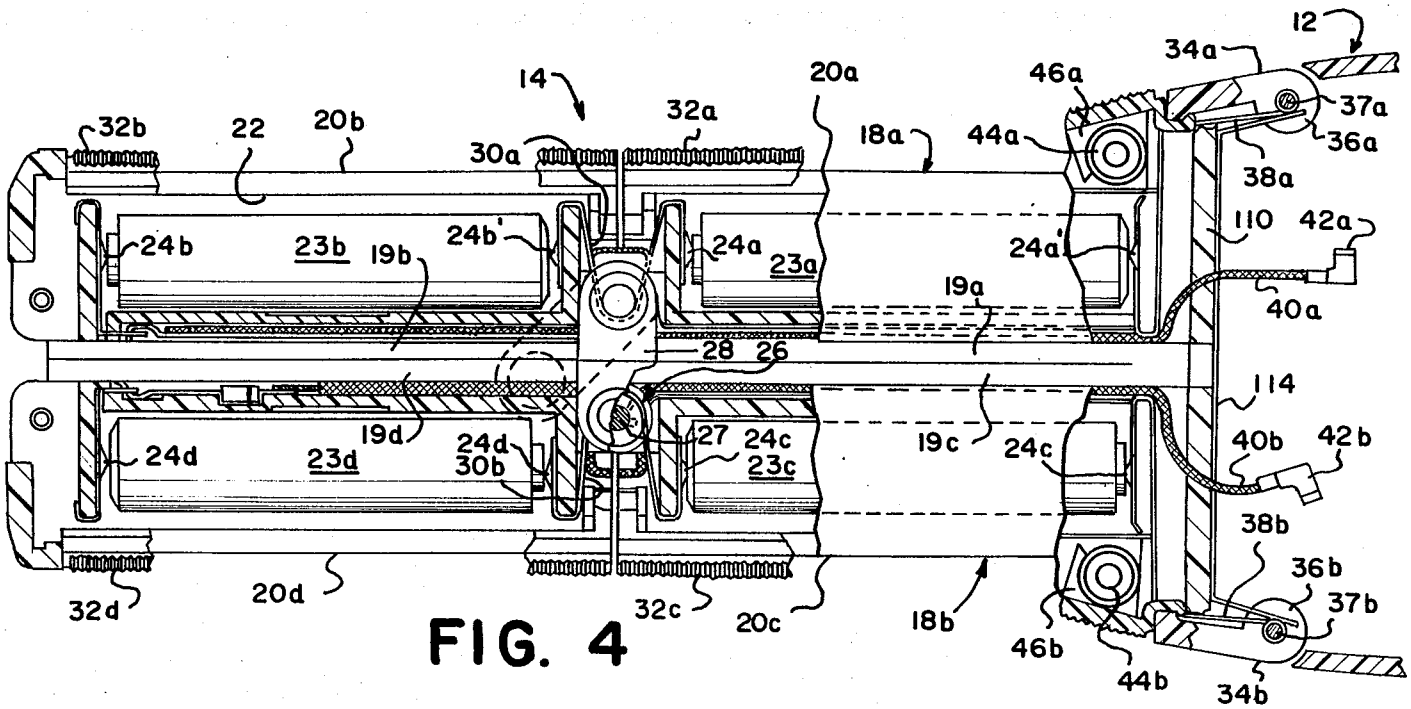
FIG. 4 is a partially cut-away view of the body assembly of the flashlight of FIG. 1 as viewed along the irregular line 4—4 in FIG. 3.

Referring now to FIG. 4, the body assembly 14 is shown in greater detail. Arm assemblies 18*a* and 18*b*, are articulated to enable them to generally conform to the body part on which they are to be mounted. In the embodiment shown, each arm assembly includes two cradle-shaped, articulated arm segments which are hinged to each other. Arm assembly 18*a* has arm segments 20*a* and 20*b*, and arm assembly 18*b* has arm segments 20*c* and 20*d*. Each arm segment, of which segment 20*b* is typical, has a battery chamber 22 for holding a power cell 23*b*. Within chamber 22 power take-off contacts 24*b* and 24*b*' are mounted at each end wall and are positioned for making electrical contact with the terminals of battery 23*b*.

The arm segments, for example 20*c* and 20*d*, are hinged together in pairs at their mating end, as at location 26, and are joined by means of hinge pin 27, which, as shown in FIG. 3, projects from the upper surface of the assembly and terminates in clasp 28. When it is desired that the flashlight 10 be maintained closed in the hand-held form, the clasp 28 pivots on one of the hinge pins 27 to interlock with the other hinge pin, thereby preventing the arm assemblies 18*a* and 18*b* from swinging apart into the open position.

The electrical circuit between batteries 23*a–d* in the arm segments 20*a–d* is respectively carried through by means of flexible hinge leaves 30*a* and 30*b*. The flexible hinge leaf 30*a* has one end connected to take-off contact 24*a* in arm segment 20*a*, and the other end connected to take-off contact 24*b*' in adjacent arm segment 20*b*. Flexible hinge leaf 30*b* is similarly connected with respect to the take-off contacts 24*c*' and 24*d* in arm segments 20*c* and 20*d* respectively.

Each arm segment 20*a*, 20*b*, 20*c*, and 20*d*, has a removable battery chamber cover 32*a*, 32*b*, 32*c*, and 32*d* respectively, for closing off the battery chamber in each segment. The battery chamber covers are conveniently provided with ridges, or other textured surface, in order to provide a good grip when the flashlight 10 is in the hand-held form and to aid removal and installation of the battery chamber covers 32*a–d* when the batteries are replaced. Resilient pads 19*a–d* are mounted on the facing surfaces of arm segments 20*a–d* respectively for the wearer's comfort.

Arm assemblies 18*a* and 18*b* have respective arm extensions 34*a* and 34*b* which project within the head assembly 12. The arm extensions 34*a* and 34*b* have journals 36*a* and 36*b* formed at their tips. The journals 36*a* and 36*b* are formed to receive metallic hinge pins 37*a* and 37*b*. The ends of the hinge pins 37*a*, 37*b* fit into recesses (not shown) in the head assembly 12 whereby the arm assemblies 18*a* and 18*b* are journalled to the head assembly 12 for pivotal displacement relative to the head assembly and to each other.

Electrical connections are provided to connect the batteries with the lamp in the head assembly 12. Flexible end leads 38*a* and 38*b* are connected between the take-off contacts 24*a*' and 24*c* at the front end of the arm assemblies 18*a* and 18*b*. The flexible ends leads 38*a* and 38*b*, are electrically connected at their other ends to the hinge pins 37*a* and 37*b* respectively.

Wire leads 40*a* and 40*b* are connected to take-off contacts 24*a* and 24*d*' as shown in FIG. 4. Wire leads 40*a* and 40*b* extend along the facing surfaces of arm segments 20*a–d*, behind the resilient pads 19*a–d*, and emerge at the front ends of arm assemblies 18*a*, 18*b*, where they terminate in respective wire lead terminals 42*a* and 42*b*. Wire lead terminals 42*a* and 42*b* are formed to provide electrical connections to contacts in the head assembly 12, as will be described more fully below.

As shown in FIGS. 1, 3, and 4, the arm segments 20*a* and 20*c* are flared at their respective front ends. In the space between the battery chambers in the cradle-shaped arm segments 20*a* and 20*c* and the respective battery chamber covers 32*a* and 32*c*, spare bulbs 44*a* and 44*b* may be stored by means of bulb holders 46*a* and 46*b* respectively. The bulb holders 46*a* and 46*b* may be in the form of resilient plastic sockets inside the front end walls of arm segments 20*a* and 20*b* respectively.

Figure 7:
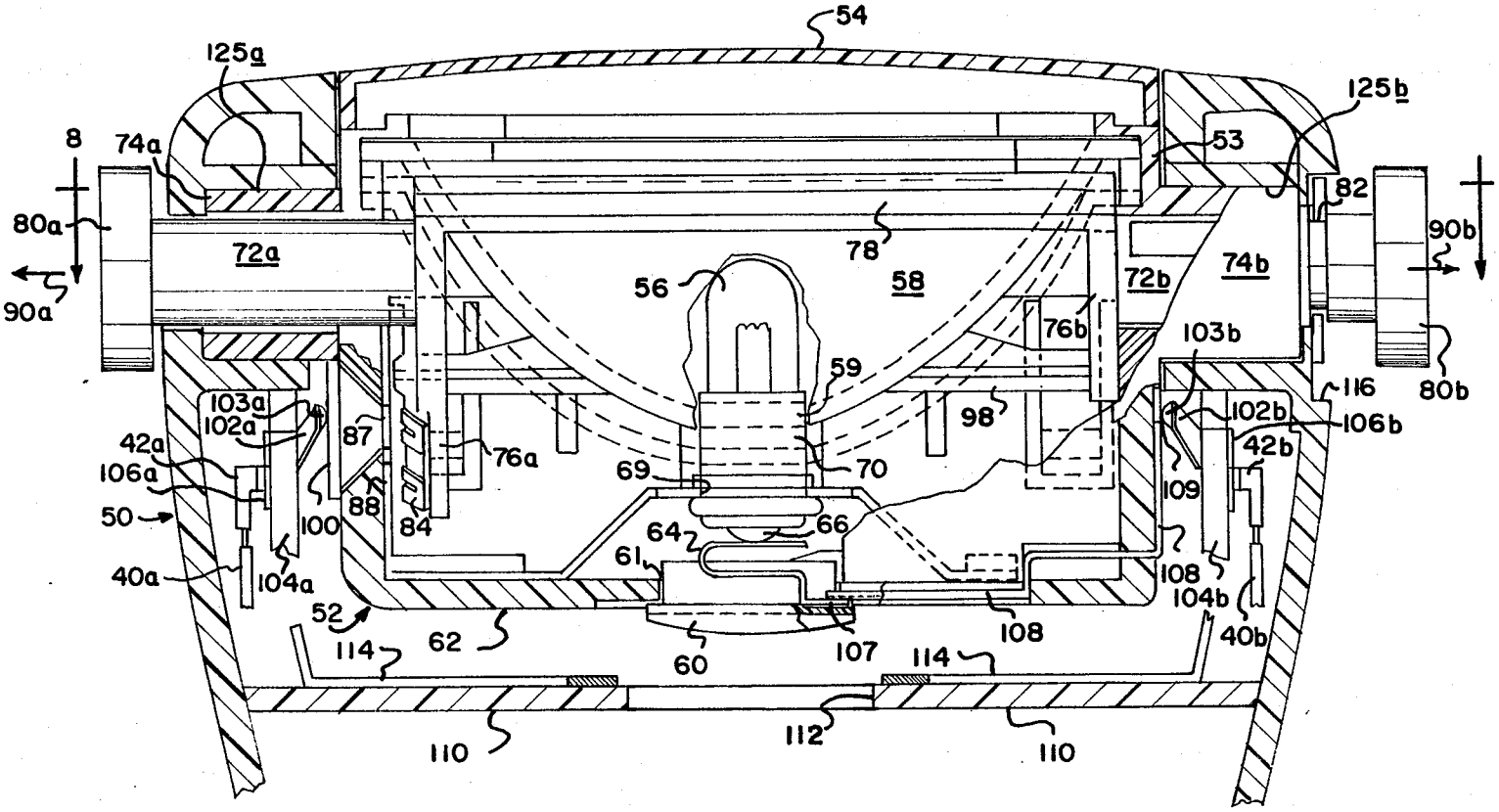
FIG. 7 is a cross-sectional view of the head assembly of the flashlight of FIG. 1 as viewed along line 7—7 in FIG. 2.

In the illustrated embodiment of the present invention, as shown in FIG. 7, the head assembly 12 of the flashlight includes an outer housing 50 which encloses most of the operational features of the flashlight 10. A hollow, tubular cup-shaped lamp housing 52 is enclosed within the outer housing 50. Lamp housing 52 includes a clear lens 54 mounted over the open end of the tubular wall 53 of the housing 52. The lamp housing 52 is adapted for mounting a light bulb 56 in the bottom thereof. A concave reflector 58, preferably parabolic in shape, having a central opening 59, is slidably mounted within the lamp housing 52. Reflector 58 is positioned within the lamp housing 52 such that the illuminating portion of light bulb 56 extends through the central opening 59.

The bulb is mounted in a base contact 68 formed of a conductive metal disposed within the lamp housing 52 adjacent the inner surface of bottom wall 62 of the housing 52. The base contact 68 has a central opening 69 which is aligned with the central opening 59 in reflector 58. The base contact 68 engages with the cylindrical bulb base 70 when the light bulb 56 is in place. A removable cap 60 cooperates with the base contact 68 to mount the bulb 56, which may be inserted and removed through an access opening 61 in bottom wall 62 of lamp housing 52. The opening 61 is closed by the cap 60 which has a contact 64 which engages with the foot contact 66 of the light bulb 56 when the cap 60 is mounted in opening 61. Cap 60 is held in opening 61 by any convenient arrangement, for example a twist-lock arrangement.

Figure 11:
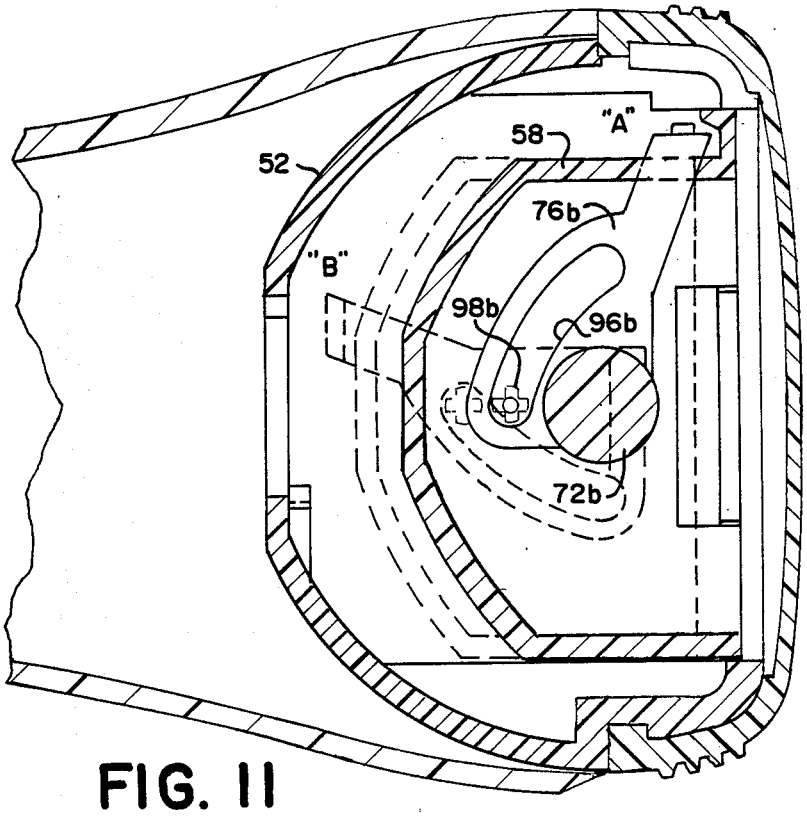
FIG. 11 is a cross-sectional view of the head assembly of the flashlight of FIG. 1 as viewed along line 11—11 in FIG. 1.
Figure 10:
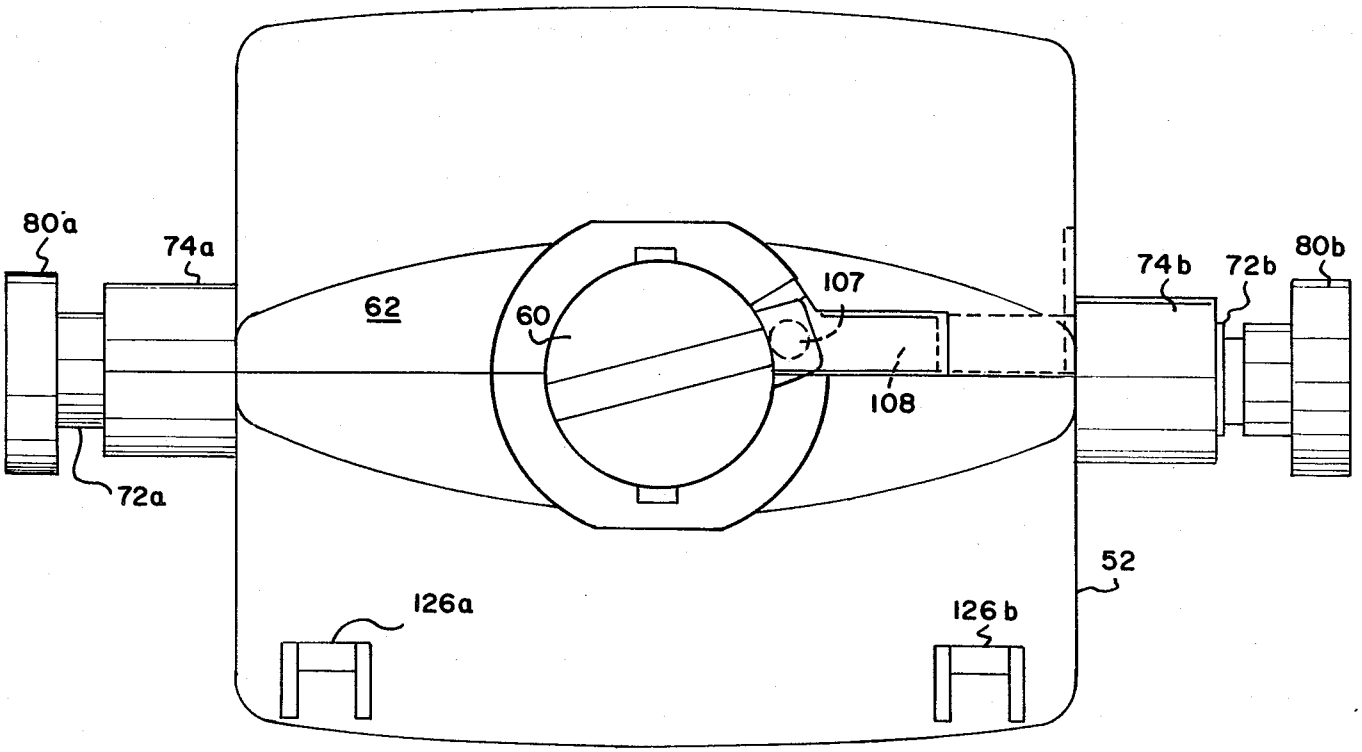
FIG. 10 is an end elevation view of the back end of the lamp housing of the flashlight of FIG. 1 as viewed along line 10—10 in FIG. 5.
Figure 12:
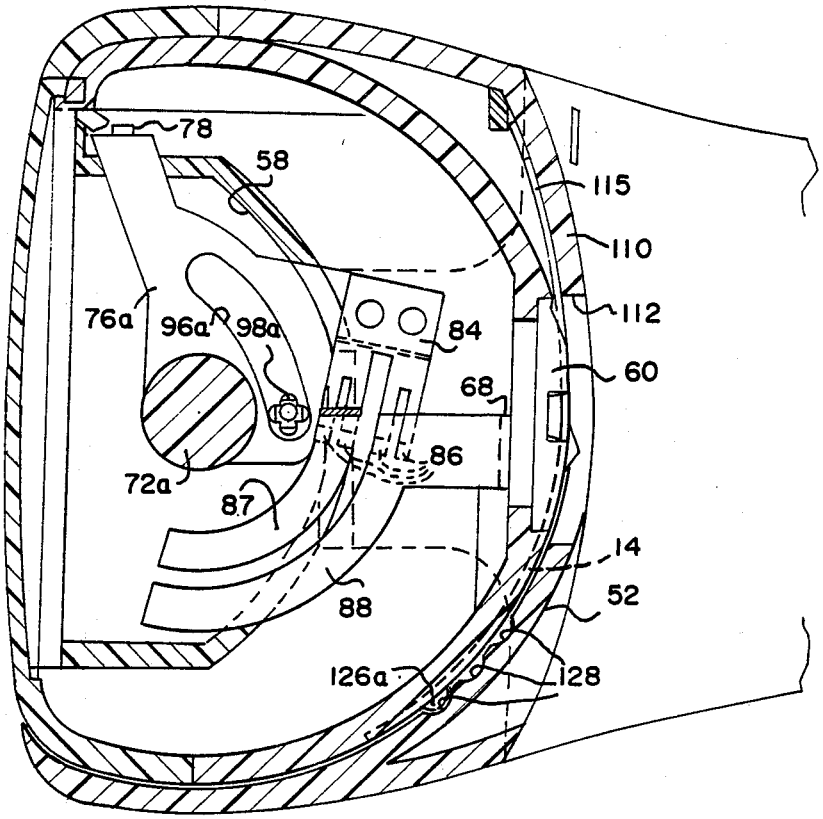
FIG. 12 is a further cross-sectional view of the head assembly of the flashlight of FIG. 1 as viewed along line 12—12 in FIG. 1.

A switching and focusing mechanism is provided in the head assembly 12 for turning the flashlight on and off, and for varying the focus of the light beam when the flashlight is on. In the illustrated embodiment, the switching and focusing mechanism is an integral assembly which includes a pair of stub shafts 72*a* and 72*b* which are rotatable and axially slidable in sleeves 74*a* and 74*b* respectively on opposite sides of the lamp housing 52 (see FIG. 8). The ends of stub shafts 72*a* and 72*b* extend through the side walls of outer housing 50. The interior ends of the stub shafts 72*a* and 72*b* are connected to focusing levers 76*a* and 76*b* respectively as shown in FIGS. 11 and 12. A tie-member 78 interconnects the focusing levers 76*a* and 76*b* thereby rigidly linking the stub shafts 72*a* and 72*b* as shown in FIG. 7.

The external ends of stub shafts 72*a* and 72*b* have end knobs 80*a* and 80*b* respectively formed thereon. The knobs 80*a* and 80*b* permit the user to switch the flashlight on and off or to adjust the focus of the light beam with either hand. A circumferential groove 82 is formed in stub shaft 72*b* adjacent the end knob 80*b*.

Means is provided to enable control of a circuit to the lamp base contact 68 when the stub shafts are displaced by the knob 80. Referring now to FIGS. 7 and 12, a bridging contact 84 is mounted on focusing lever 76*a*. The bridging contact 84 includes a plurality of fingers having wiping points 86 formed thereon cooperable with an arcuate contact 87, and an arcuate segment 88 of base contact 68, which are mounted parallel to one another on the interior surface of the side wall of lamp housing 52. The arcuate contact 87 and arcuate segment 88 of base contact 68 are electrically isolated from each other, but are dimensioned and positioned to register with the points 86 and be electrically interconnected when bridging contact 84 is displaced into engagement with the two arcuate elements 87 and 88.

Stub shafts 72*a* and 72*b* slide axially within the respective sleeves 74*a* and 74*b* in the directions indicated by arrows 90*a* and 90*b* as shown in FIG. 7. Accordingly, when the stub shafts 72*a* and 72*b* are displaced in the direction indicated by arrow 90*a*, the contact points 86 of bridging contact 84 are brought into electrical engagement with both the arcuate contact 87 and the arcuate segment 88 of base contact 68, thereby closing the circuit for energizing the light bulb 56. In like manner, when the stub shafts 72*a* and 72*b* are displaced in the direction indicated by arrow 90*b*, the bridging contact 84 is disengaged from the arcuate contact 87 and the arcuate segment 88 of base contact 68, thereby opening the light bulb energizing circuit. It is readily apparent that the stub shafts 72*a* and 72*b* are slidable within the head asembly to a first position wherein the light bulb is energized by virtue of being connected to a power source, and that the stub shafts are also slidable to a second position wherein the light bulb is disconnected from the power source. The light bulb energizing circuit is shown schematically in FIG. 14.

Figure 8:
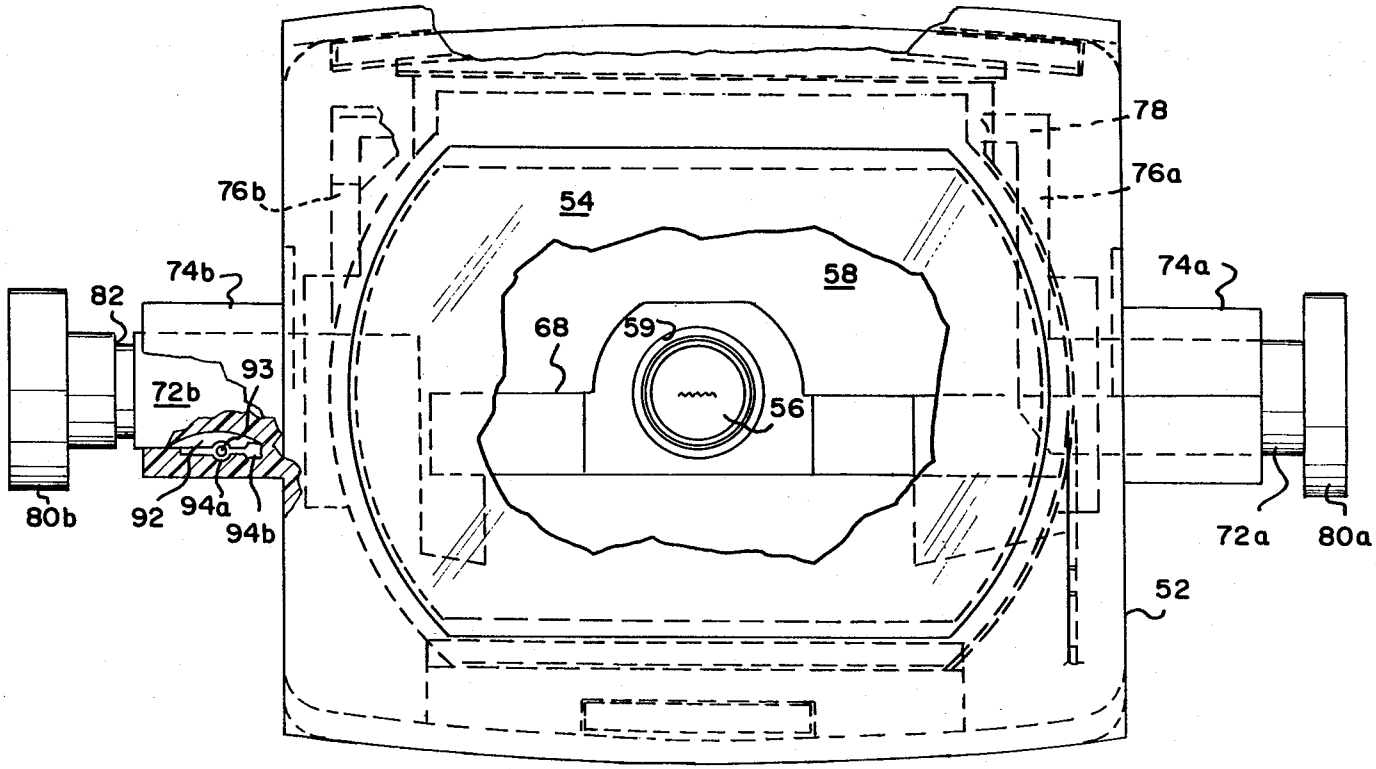
FIG. 8 is a partially cut-away view of the front of the lamp housing of the flashlight of FIG. 1 as viewed along irregular line 8—8 in FIG. 7.

As shown in FIG. 8, the switching mechanism is maintained in either the "on" or "off" position by means of a spring detent component 92 in stub shaft 72*b*. The detent 92 has a ball 93 which alternatively engages grooves 94*a* or 94*b* formed in sleeve 74*b*. The detent 92 is flexibly mounted in the stub shaft 72*b* such that it can move from groove 94*a* to 94*b* and vice versa when stub shaft 72*b* is displaced in one direction or the other.

The head assembly 50 also includes a mechanism for varying the focus of the light beam emanating from light bulb 56 when energized. The focusing mechanism is integral with the switching mechanism described above.

As shown in FIGS. 11 and 12, the focusing levers 76*a* and 76*b* have cam slots 96*a* and 96*b* respectively, formed therein. The reflector 58 is mounted on a cross arm 98, the opposite ends 98*a* and 98*b* of which extend through the cam slots 96*a* and 96*b*. In the embodiment illustrated in the drawings, the cross arm 98 is configured as a pair or stub arms 98*c* and 98*d* which extend laterally from the back of reflector 58. At its open end, the reflector is slidable axially within the tubular wall 53 of the housing 52. The focusing levers 76*a* and 76*b* translate rotation of the stub shafts 72*a* and 72*b* respectively into axial displacement of the reflector 58 toward and away from the base contact 68. As shown in FIG. 11, when stub shaft 72*b* is rotated, the focusing lever 76*b* rotates between positions "A" and "B". The rotation of the focusing lever 76*b* causes the end 98*b* of the cross arm 98 to move forward or backward by virtue of the cam slot 96*b*. Focusing lever 76*a*, being rigidly connected to focusing lever 76*b* by tie-member 78, acts in a similar manner on cross arm end 98*a*. The central opening 59 in reflector 58 is dimensioned to permit the reflector 58 to move relative to the light bulb 56. As the reflector 58 is moved backward or forward by means of the focusing mechanism, the light beam emanating from light bulb 56 is varied in focus from a widely dispersed "flood" beam to a narrow "spot" beam depending on the particular work application.

A distinct advantage of the arrangement of the switching and focusing mechanism of the present invention, in particular the arrangement of arcuate contact 87, arcuate segment 88 of base contact 68 and the wiping contact 84, is that it provides a single, integral control mechanism for both on/off switching and light beam focus adjustment. Such an arrangement permits the user to adjust the focus of the light beam without having to turn the flashlight on or off. Moreover, the focus adjustment can remain set for the next use since it is not affected by the switching operation.

Figure 5:
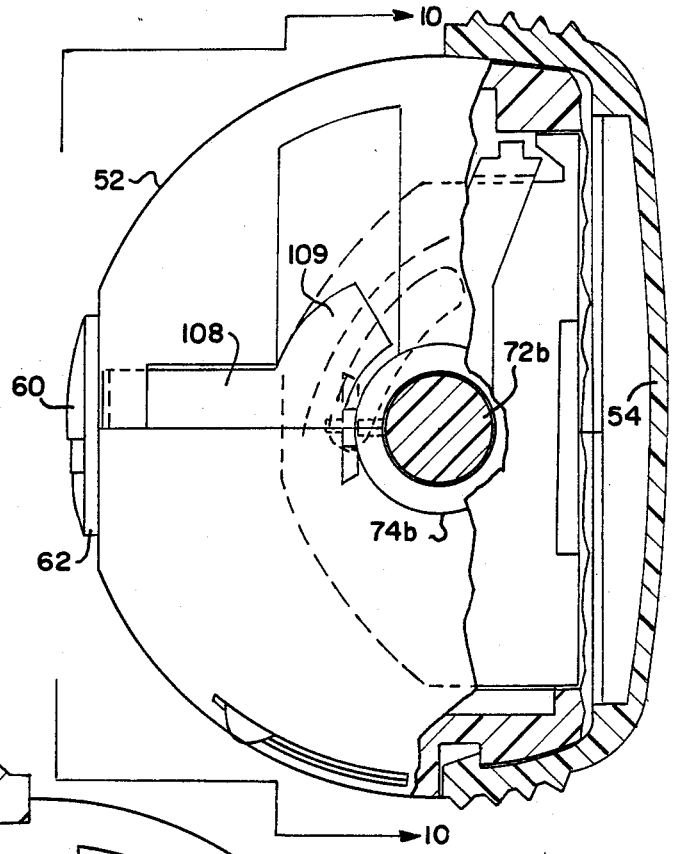
FIG. 5 is a side view in partial section of the lamp housing of the flashlight of FIG. 1 as viewed along line 5—5 in FIG. 2.
Figure 6:
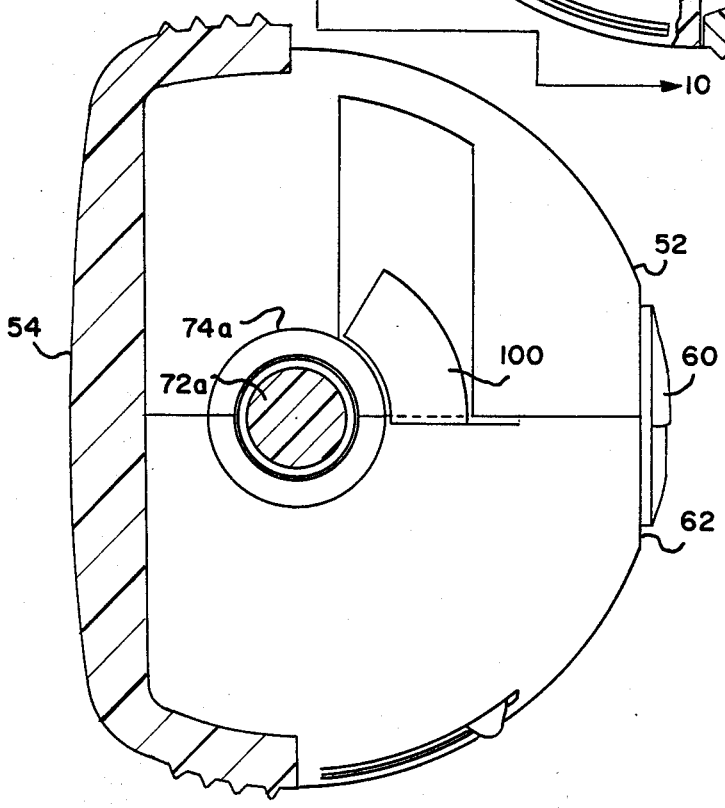
FIG. 6 is another side view of the lamp housing of the flashlight of FIG. 1 as viewed along line 6—6 in FIG. 2.

The electrical circuit connecting the light bulb 56 to the power cells 23*a–d* is completed by means of a novel contact arrangment which will now be described with reference to FIGS. 5, 6, and 7. Arcuate contact 87 passes through the side wall of lamp housing 52 and terminates in an external arcuate segment 100. A wiping contact 102*a* is mounted on an internal wall segment 104*a* of outer housing 50. The wiping contact 102*a* has a point portion 103*a* which electrically engages with the external segment 100. The wiping contact 102*a* also has a connecting tab 106*a* to which the wire lead terminal 42*a* is connected such as by soldering or other means.

Figure 4A:
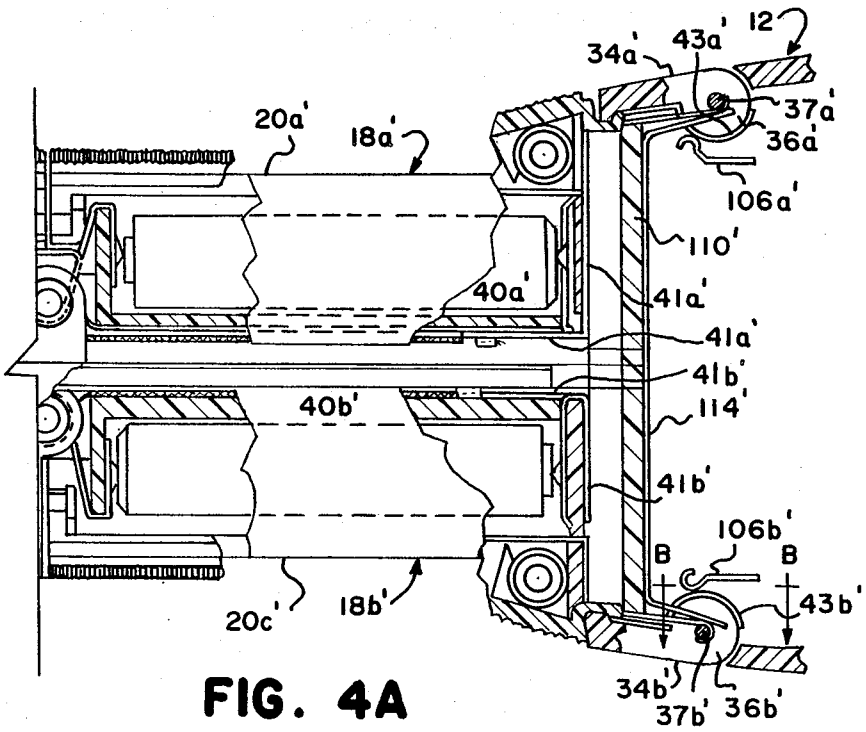
FIG. 4A is a partial cut-away view of a body assemby of the flashlight of FIG. 1 showing a further arrangement of the electrical connections to the head assembly.
Figure 4B:
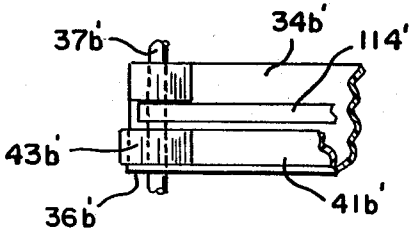

A further embodiment of the convertible flashlight of the present invention is shown in FIGS. 4A and 4B. The wire leads 40*a*′ and 40*b*′ are terminated as by soldering or crimping onto semi-rigid conductors 41*a*′ and 41*b*′. Conductors 41*a*′ and 41*b*′, which may be fabricated of copper or brass strip material, run along the facing surfaces and the front end walls of cradle-shaped arm segments 20*a*′ and 20*c*′ and along the interior of arm extensions 34*a*′ and 34*b*′. Conductors 41*a*′ and 41*b*′ terminate in curved segments 43a' and 43b' generally conforming to the surface of the journals 36a', 36b' at the ends of the arm extensions 34a' and 34b'.

In the embodiment shown in FIGS. 4A and 4B, the connecting tabs 106a' and 106b' of wiping contacts 102a' and 102b', are formed to make wiping engagement with the conductors 41a' and 41b' respectively. Such arrangement maintains electrical continuity between the body assembly and the head assembly whether the arm assemblies 18a' and 18b' are extended or closed. The arrangement avoids the disadvantage of having wire leads extending between the body assembly and the head assembly, which could become crimped or broken when the flashlight is converted between the hand-held and the body-mountable forms.

The cap contact 64 in cap 60 has a wiping tab portion 107 which electrically engages with a through-contact 108 extending along and through the opposite side wall of lamp housing 52, and terminates in an arcuate segment 109.

A wiping contact 102b is mounted on a second internal wall segment 104b of outer housing 50. Wiping contact 102b has a point portion 103b which engages with the arcuate segment 109 of through-contact 108. The wiping contact 102b has a connecting tab 106b to which the wire lead terminal 42b is connected. The arcuate segments 100 and 109, as shown in FIGS. 5 and 6, are centered on the rotary axis of the sleeves 74a and 74b to maintain electrical contact when the sleeves are pivotally displaced in the housing 50, as described hereinafter.

The electrical circuit for energizing the light bulb 56 is completed by means of a jumper lead 114 which runs along the transverse wall 110 of outer housing 50 and connects the flexible end leads 38a and 38b together so as to connect the batteries 23a–d in series. It is noted that jumper lead 114 has an offset 115 as shown in FIGS. 7 and 12 which passes around the aperture 112 in wall 110. Aperture 112 is provided in wall 110 in order to gain access to the bulb retaining cap 60.

Figure 9:
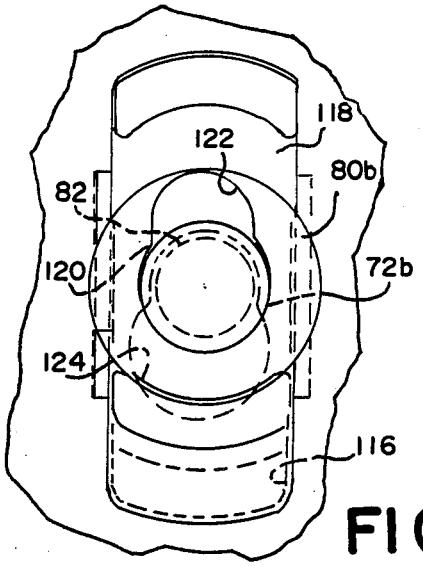
FIG. 9 shows the switch locking mechanism of the flashlight of FIG. 1 as viewed along line 9—9 in FIG. 2.

The switching mechanism for the flashlight according to the present invention, is provided with a convenient locking mechanism to prevent inadvertent switching-on of the flashlight and the resultant waste of battery power. Referring now to FIGS. 7 and 9, there is shown a recess 116 in the side wall of outer housing 50 surrounding the location where stub shaft 72b extends through the side wall. A slide lock 118 is slidably mounted within recess 116. The slide lock 118 has an overall length which is shorter than the overall length of recess 116 thereby permitting the slide lock 118 to slide within recess 116. Slide lock 118 has a central slot 120 having a narrow portion 122 and a wide portion 124. The narrow portion 122 of slot 120 is dimensioned such that it surrounds stub shaft 72b only at the circumferential groove 82. In such position the slide lock 118 is in the "locked" position and the flashlight switch mechanism is not operable. The wide portion 124 of slot 120 is dimensioned to surround the outer circumference of stub shaft 72b and to permit stub shaft 72b to slide there through when slide lock 118 is in the "unlocked" position. In that position flashlight switch mechanism is operable.

The lamp housing 52 is tiltable within the outer housing 50. The sleeves 74a and 74b rotate in sockets 125a and 125b respectively in outer casing 50, so that the housing may pivot on an axis transverse to the axis of the light beam directed by the reflector. Tilting of lamp housing 52 is controlled by means of a pair of detents 126a and 126b (FIG. 12) located along the bottom of of lamp housing 52. The detents slide in and out of a plurality of ridges 128 whereby a plurality of discrete tilt positions are determined. It will be appreciated that the continuity of the electrical circuit of the flashlight according to the present invention is continuously maintained throughout the range of tilt of the lamp housing 52 by means of the concentric arrangement of arcuate segments 100 and 109 relative to the tilt axis as they connect with wiping contacts 102 and 102b respectively. The arcuate angle of the segments 100 and 109 corresponds to the tilt range of the lamp housing 52 in the sockets 125a and 125b.

Figure 14:
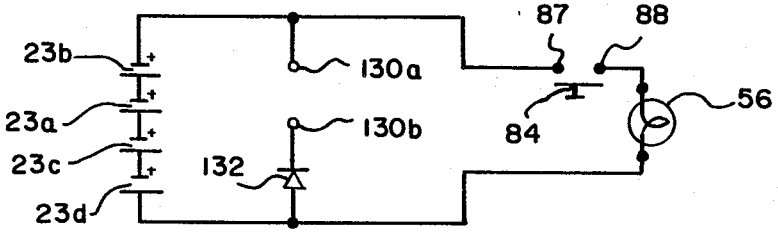
FIG. 14 is a schematic diagram of a preferred electrical circuit for the flashlight of the present invention.

The convertible flashlight according to the present invention can be adapted to permit convenient recharging of the power cells 23a–d in place. As shown in FIG. 14, contacts 130a and 130b are provided in the light bulb energizing circuit. Contacts 130a, 130b are physically located and flush-mounted on the bottom side of the flashlight, adjacent the hinge between arm segments, as shown in FIG. 3 for contact 130b. Such an arrangement permits the flashlight to be conveniently and easily connected to and disconnected from a recharging unit having a mating contact arrangement. Such recharging units are generally known and are not considered to be a part of the present invention.

A diode 132 is connected between recharging contact 130b and the negative terminal of power cell 23d as shown in FIG. 14 to prevent draining of the power cells if the contacts 130a and 130b are inadvertently short-circuited.

Some of the many novel features and advatages of the present invention may now be apparent in view of the foregoing detailed description. For example, a novel flashlight has been described which is convertible between a hand-held form and a body mountable form. The flashlight includes a head assembly having a lamp housing which encloses the light bulb. The lamp housing includes an integrated switching and focusing mechanism operable from an external button on the flashlight. A distinct advantage of the switching/focusing mechanism is that it permits the flashlight to be turned on or off without affecting the focus setting. A further advantage of the unique head assembly of the flashlight according to the present invention is that the lamp housing is tiltable within the outer casing of the head assembly under the control of detent means. A novel contact arrangement is advantageously provided to maintain electrical continuity of the flashlight electrical circuit throughout its adjustment. Convertibility is provided by a unique body assembly including two articulated arm assemblies, both hinged at one end to the head assembly, but which are free to swing apart. The batteries which power the flashlight are retained in chambers inside the respective arm assemblies, thereby making the flashlight a complete unit.

It will be recognized by those skilled in the art that changes or modifications may be made to the above described embodiment without departing from the broad inventive concepts of the invention. It is understood, therefore, that the invention is not limited to the particular embodiments which are disclosed, but is intended to cover all modifications and changes which are within the scope of the invention as defined in the appended claims.

What is claimed is:

1. A flashlight that is convertible between a hand-held form and a body-mountable form, said flashlight comprising:

a head assembly including a light bulb mounted therein for casting light from said head assembly when energized;

a body assembly operatively connected to said head assembly, said body assembly having a first form suitable for grasping by hand, and a second form suitable for mounting on a person's body, said body assembly comprising a pair of articulated arm assemblies each pivotally connected at one end to said head assembly such that the free ends of said arm assemblies can swing away from each other to an open position to form a yoke-like device, and toward each other to a closed position to form a handle, each arm assembly comprising a pair of pivotally coupled together arm segments, each of said arm segments holding a power cell and flexible hinge leaf means intermediate adjacent arm segments that are pivotally coupled together to provide an electrical circuit between power cells in the arm segments;

means for retaining the flashlight on a person's body when said body assembly is in the second form, and the said means for retaining comprising adjustable elastic strap means to provide a connection between the free end of the arm assemblies, said strap means being adapted to encircle a body part for retaining said body assembly on the body part.

2. A flashlight as recited in claim 1 wherein said head assembly comprises:

a concave reflector having a central opening therein, said concave reflector being mounted in the head assembly such that the light bulb projects through the central opening whereby light emanating from the light bulb is reflected out of said head assembly as a light beam.

3. A flashlight as recited in claim 2 wherein said concave reflector is displaceable relative to the light bulb, and said head assembly further comprises means for effecting controlled displacement of said concave reflector relative to the light bulb, axially of said light beam, whereby the focus of the light beam emanating from the light bulb can be varied.

4. A flashlight as recited in claim 3 wherein said means for effecting controlled displacement of said concave reflector comprises:

shaft means mounted in said head assembly so as to be rotatable about an axis transverse to said light beam; and translation means operatively connected between said shaft means and said concave reflector for translating rotation of said shaft means into axial displacement of said concave reflector relative to the light bulb.

5. A flashlight as recited in claim 1 wherein said head assembly comprises:

a lamp housing for holding the light bulb, said housing having a reflector for directing the light in a beam; and means mounting said lamp housing in said head assembly so as to be tiltable about an axis transverse to the light beam.

6. A flashlight as recited in claim 5 wherein said head assembly comprises an outer casing enclosing said lamp housing, said outer casing having a pair of opposed sidewalls including socket means for supporting the mounting means of said lamp housing such that said lamp housing can be tilted in said socket means.

7. A flashlight as recited in claim 6 wherein said lamp housing comprises a cylindrical sleeve extending from each side of said lamp housing and formed to fit within the socket means for rotation therein.

8. A flashlight as recited in claim 7 wherein said lamp housing comprises a detent disposed on an external surface of the lamp housing, and said outer casing comprises a plurality of adjacent ridges positioned for engagement with said detent whereby the lamp housing can be held in one of a discrete number of tilted positions.

9. A flashlight as recited in claim 6 wherein said head assembly comprises electrically conductive means for maintaining electrical continuity between the lamp housing and the outer casing when the lamp housing is tilted among various positions.

10. A flashlight as recited in claim 9 wherein said electrical continuity maintaining means comprises:

an arcuate contact concentric with said socket means defining an angle corresponding to the tilt range of the lamp housing; and a wiping contact formed and positioned to engage said arcuate contact;

one of said arcuate and wiping contacts being mounted externally on a side wall of the lamp housing and the other of said contacts being mounted internally on the outer casing.

11. A flashlight that is convertible between a hand-held form and a body-mountable form, said flashlight comprising:

a head assembly including a light bulb mounted therein for casting light from said head assembly when energized;

a body assembly operatively connected to said head assembly, said body assembly having a first form suitable for grasping by hand, and a second form suitable for mounting on a person's body;

means for retaining the flashlight on a person's body when said body assembly is in the second forms;

a concave reflector having a central opening therein, said concave reflector being mounted in the head assembly such that the light bulb projects through the central opening whereby light emanating from the light bulb is reflected out of said head assembly as a light beam, said concave reflector being displaceable relative to the light bulb, and said head assembly further comprising means for effecting controlled displacement of said concave reflector relative to the light bulb, axially of said light beam, whereby the focus of the light beam emanating from the light bulb can be varied, the head assembly further comprising electrical connection means for energizing the light bulb from a power cell;

said means for effecting controlled displacement of said concave reflector comprising means for interrupting said electrical connection means to deenergize the light bulb;

said electrical connection means comprising a pair of terminal contacts in spaced parallel relation and said means for effecting controlled displacement comprising shaft means mounted in said head assembly so as to be rotatable about and displaceable along the axis of said shaft means;

translation means operatively connected between said shaft means and said concave reflector for translating a rotation of said shaft means into displacement of said concave reflector relative to the light bulb, axially of said light beam; and a bridging contact disposed along and movable with said shaft means adjacent said pair of terminal contacts;

said shaft means being displaceable axially thereof in said head assembly to a first position wherein said bridging contact engages and connects said terminal contacts together to energize the light bulb from the power cell, or to a second position wherein said bridging contact does not engage both of said terminal contacts whereby the light bulb is electrically disconnected from the power cell.

* * * * *

UNITED STATES PATENT AND TRADEMARK OFFICE

CERTIFICATE OF CORRECTION

PATENT NO. : 4,916,596

DATED : April 10, 1990

INVENTOR(S) : Sharrah et al.

It is certified that error appears in the above-identified patent and that said Letters Patent is hereby corrected as shown below:

On the title page:

The Assignee's name is spelled incorrectly. Please correct the name to read --Streamlight, Inc.--.

Column 1, line 7, delete "to" and insert --a--.

Column 2, line 40, after the numeral "4" insert --B--.

Column 3, line 29, delete "flshlight" and insert --flashlight--.

Column 4, line 28, delete "24a" and insert --24b--.

Column 6, line 16, delete "or" and insert --of--.

Column 6, line 57, after "external" insert --arcuate--.

Column 8, line 34, delete "advatages" and insert --advantages--.

Signed and Sealed this

Thirty-first Day of December, 1991

*Attest:*

HARRY F. MANBECK, JR.

*Attesting Officer*

*Commissioner of Patents and Trademarks*